US009022885B2

(12) United States Patent
Munro

(10) Patent No.: US 9,022,885 B2
(45) Date of Patent: May 5, 2015

(54) PORTABLE COLLAPSIBLE SPORTS GOAL AND CARRYING CASE

(76) Inventor: Graham A. Munro, Pasadena, CA (US)

( * ) Notice: Subject to any disclaimer, the term of this patent is extended or adjusted under 35 U.S.C. 154(b) by 174 days.

(21) Appl. No.: 13/589,008

(22) Filed: Aug. 17, 2012

(65) Prior Publication Data

US 2014/0051532 A1 Feb. 20, 2014

(51) Int. Cl.

| | |
|---|---|
| ***A63B 63/00*** | (2006.01) |
| ***A45F 4/02*** | (2006.01) |
| *A63B 71/00* | (2006.01) |

(52) U.S. Cl.

CPC ..... *A63B 63/004* (2013.01); *A45F 4/02* (2013.01); *A63B 71/0036* (2013.01); *A63B 2209/10* (2013.01); *A63B 2210/54* (2013.01)

(58) Field of Classification Search

CPC ..... A63B 63/04
USPC ..... 473/476, 478; 273/400, 118 R; D21/780
See application file for complete search history.

(56) References Cited

U.S. PATENT DOCUMENTS

| | | | | |
|---|---|---|---|---|
| 3,039,273 | A * | 6/1962 | Swindell | 405/186 |
| 3,428,325 | A * | 2/1969 | Atkinson | 473/256 |
| 4,339,132 | A | 7/1982 | Stevens | |
| 4,798,497 | A * | 1/1989 | Bloos | 405/186 |
| 5,244,213 | A | 9/1993 | Armell | |
| 5,433,433 | A | 7/1995 | Armell | |
| 7,341,531 | B2 * | 3/2008 | Caruso | 473/478 |
| 2002/0100777 | A1 * | 8/2002 | Zheng | 224/153 |
| 2005/0197212 | A1 * | 9/2005 | Turcot | 473/407 |
| 2006/0232013 | A1 * | 10/2006 | Quinn | 273/400 |
| 2012/0052992 | A1 | 3/2012 | Uribe | |
| 2012/0316012 | A1 * | 12/2012 | Thackeray | 473/457 |
| 2014/0051532 | A1 * | 2/2014 | Munro | 473/478 |

OTHER PUBLICATIONS

Webpage download, Amazon, 2012, www.amazon.com/GOLME-Urban-Backpack-Soccer-Goal/dp/B009WUH58Y/, 1 page.*

Webpage download, YouTube, 2010, www.youtube.com/watch?v=cJ3NXi21z7k, 4 pages.*

* cited by examiner

*Primary Examiner* — Gene Kim

*Assistant Examiner* — Michael Chambers

(74) *Attorney, Agent, or Firm* — Law Offices of Kamran Fattahi

(57) ABSTRACT

The present invention discloses a device, comprising a collapsible sports goal that is housed and anchored by a backpack.

27 Claims, 26 Drawing Sheets

PORTABLE COLLAPSIBLE SPORTS GOAL AND CARRYING CASE

BACKGROUND OF THE INVENTION

1. Field of the Invention

This invention generally relates to sports goals, and more particularly, to portable collapsible sports goals with a carrying case in a form of a non-limiting, exemplary backpack.

2. Description of Related Art

Conventional portable collapsible sports goals and their exclusively dedicated carrying cases are well known and have been in use for a number of years. Regrettably, most conventional portable collapsible sports goals and their dedicated carrying case suffer from obvious disadvantages in that the conventional sports goal carrying case is exclusively and solely made and dedicated only for the purpose of carrying a specific type of portable collapsible sports goal and generally, nothing more. Therefore, a user of such equipment is required to carry (at the very least) two carrying cases, the conventional portable collapsible sports goal carrying case (with the sports goal) and another carrying case such as a backpack to carry other items such as water, food, snacks, etc. Of course, the number of bags or carrying cases increases if the user (such as a coach) is responsible in providing water or snacks for an entire team of players, where more space is required to carry all of the extra food, water, or any other item (such as score books, laptops, and etc.) desired by the coach or other users.

A further drawback with respect to the conventional sports goal carrying cases is that their size, overall configuration (or style), and form-factor is exclusively commensurate with the shape of a corresponding portable sports goal in collapsed position. This type of configuration makes the conventional carrying case bulky and awkward shaped, making it difficult for users to carry other bags or carrying cases together with conventional the sports goal carrying case.

Most conventional portable collapsible sports goals include straps (such as VELCRO®) that are used to maintain and retain the sports goals in their collapsed position. Accordingly, one of the limitations of the conventional sports goals is that they require to be strapped to remain in collapsed position, and that their corresponding conventional sports goal carrying cases must have a sufficiently small interior volume so that the exclusively commensurate conventional sports goal itself can tightly fit within the carrying case and not expand or open. This way, if a strap were loose, the carrying case would continue to contain the sports goal in its collapsed position. However, this required small interior volume for a tight fit significantly limits and does not allow the conventional carrying case to be used for carrying other items. A further drawback with respect to the conventional sports goal carrying cases is that they fully separate and detach from the actual sports goal, which makes them vulnerable to loss.

A further drawback with the conventional portable collapsible sports goals is that they are not simple to use and in fact, require the user to follow a set of instructions or steps to properly and correctly collapse the portable sports goal from its default open position to its closed position. Additionally, after collapsing the goal to its closed position, the user must use a set of straps to secure the collapsed goal to maintain it in its closed position. Thereafter, the collapsed and strapped conventional sports goal is then placed into its exclusive bag or carrying case for storage.

When in use, the conventional portable collapsible sports goals require to be anchored. The conventional sports goals use a set of anchoring pins (prone to loss or breakage) to secure the conventional portable collapsible sports goals onto a field, which, in turn, obviously require and necessitates the use of a playing field that has a penetrable ground so that the anchor pins can penetrate to secure the sports goal onto the field. Therefore, most conventional portable collapsible sports goals cannot be used on hard surfaces where the anchoring pins cannot penetrate, such as concrete, asphalt, or artificial turf, compelling the use of sandbags or other types of anchoring weight.

Accordingly, in light of the current state of the art and the drawbacks to current portable collapsible sports goals and their respective carrying cases mentioned above, a need exists for a carrying case and portable collapsible sports goal combination that would enable a user to comfortably carry more than just the portable collapsible sports goal. In addition, a need exists for a carrying case and portable collapsible sports goal that is simple to use without requiring instructions, straps, anchoring pins, etc.

BRIEF SUMMARY OF THE INVENTION

An exemplary, non-limiting aspect of the present invention provides a device, comprising a collapsible sports goal that is housed and anchored by a carrying case.

Another exemplary, non-limiting aspect of the present invention provides a sports goal, comprising:

- a frame;
- an anchor flexibly associated with the frame;
- a net associated with the frame and a first section of the anchor; and
- a second section of the anchor extending beyond a lower portion of the net;
- with the frame and the anchor moving in relation to one another between an open and a collapsed, closed positions.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout:

FIGS. 4A-1 to 4F are non-limiting, exemplary illustrations of an enforcement member and anchoring mechanisms of the portable collapsible sports goal and backpack shown in FIGS. 1 to 3D;

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Throughout the disclosure, references to a backpack are meant as illustrative of a preferred embodiment and only for convenience of an example of a preferred carrying case and therefore, should not be limiting. In general, the non-limiting example of a backpack as a carrying case is provided throughout the disclosure and preferred due to its extensive use by the majority of population (almost a "lifestyle" for some) from school children to college students, working adults, hikers, travelers, etc. In general, backpacks are very popular because of their versatility (e.g., they are compact, easy to carry around, and have efficient storage capacity, etc.). Of course, other carrying cases may also be used with the present invention, non-limiting, non-exhaustive list of examples of which may include totes, duffels, carry-on bag, luggage, or case, or any combinations thereof, or a conventional backpack with backpack straps and wheels that is both a backpack and functions as a carry-on case or bag.

Figure 1:
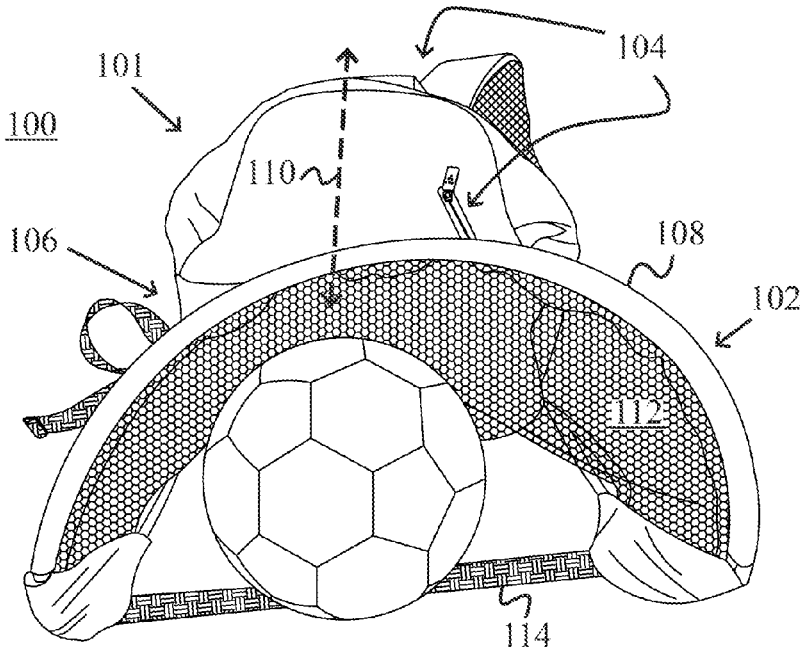
FIG. 1 is a non-limiting, exemplary illustration of a portable collapsible sports goal and backpack in accordance with the present invention.

FIG. 1 is a non-limiting, exemplary illustration of a portable collapsible sports goal and backpack in accordance with the present invention. As illustrated in FIG. 1, the present invention provides a backpack 101 and a portable collapsible sports goal 102 combination, referenced as 100, which enables users to comfortably carry more than just the portable collapsible sports goal 102 and further, which may be used on any type of hard or soft surface and is simple to use without requiring instructions, straps, anchoring pins, etc. In other words, the present invention 100 provides a collapsible sports goal 102 that is housed and anchored by a carrying case 101.

The device 100 of the present invention includes a backpack 101 that has one or more pockets 104 (just as a conventional backpack) for accommodating various articles and further, includes a sports goal pocket 106 for accommodating the collapsible sports goal 102 in accordance with the present invention. The one or more pockets 104 are readily accessible for normal use, and the sports goal pocket 106 is positioned within the backpack 101 so to not hinder and obstruct easy access to the one or more pockets 104.

Figure 2A:
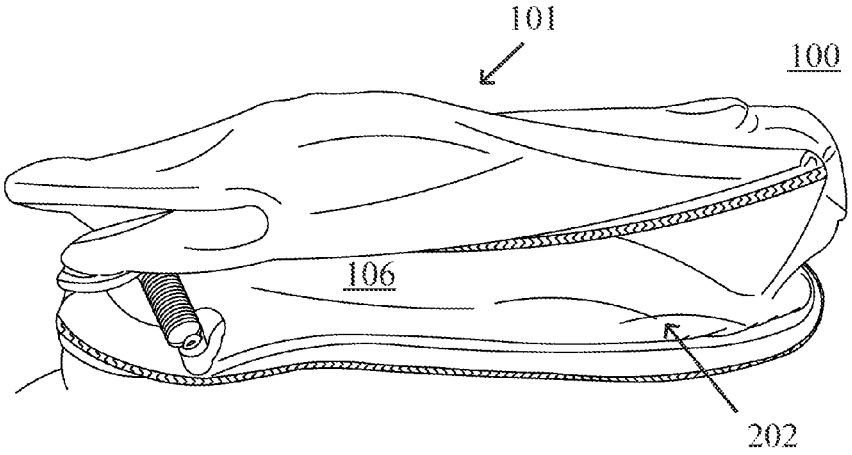
FIGS. 2A to 2F are non-limiting, exemplary illustrations of the device (the portable collapsible sports goal and backpack combination) of FIG. 1, progressively illustrating the gradual extraction of the portable collapsible sports goal from within the backpack in accordance with the present invention.
Figure 2B:
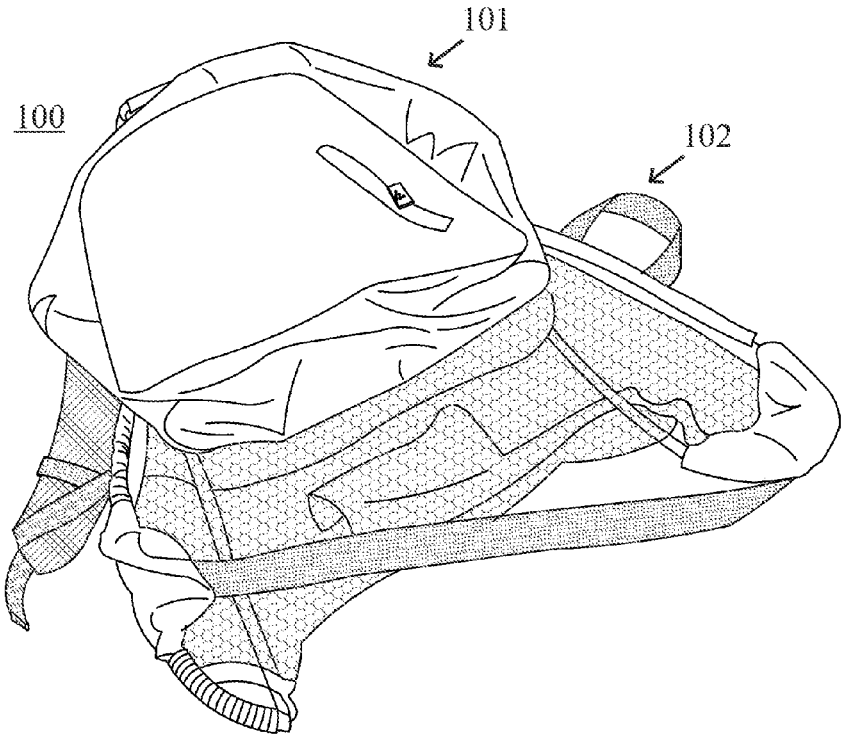
Figure 2C:
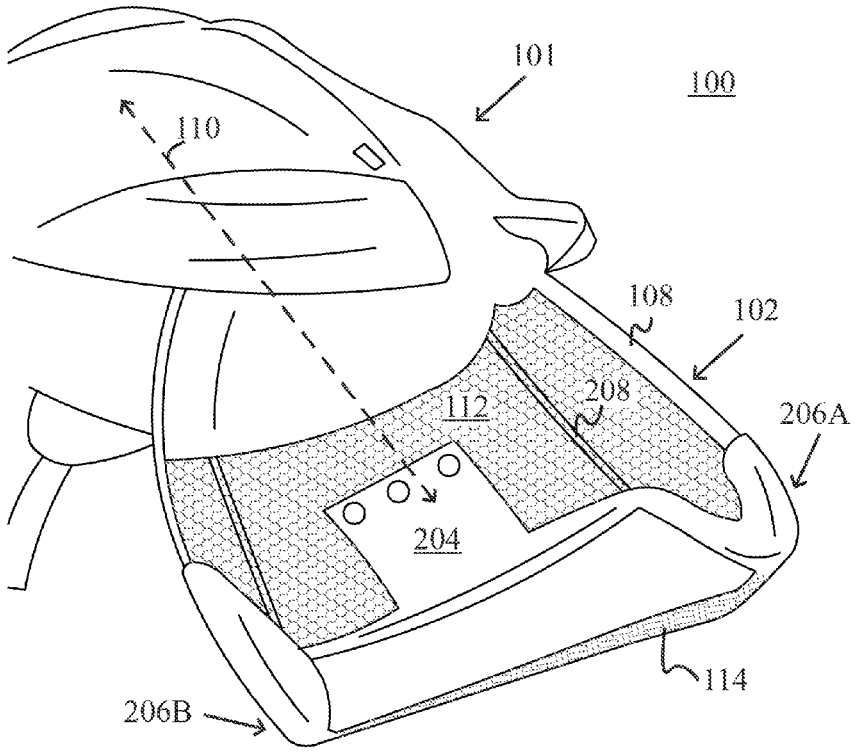
Figure 2D:
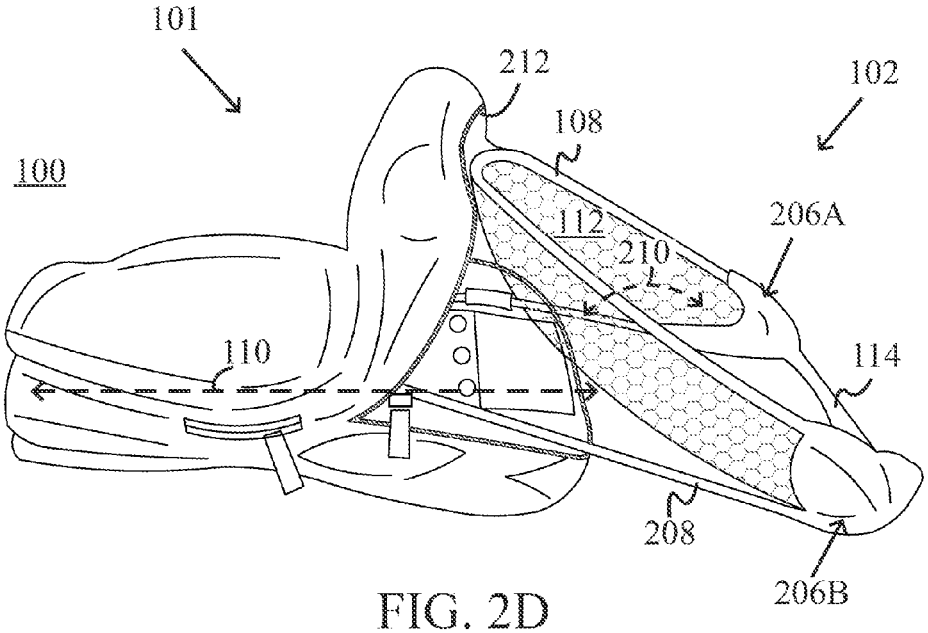
Figure 2E:
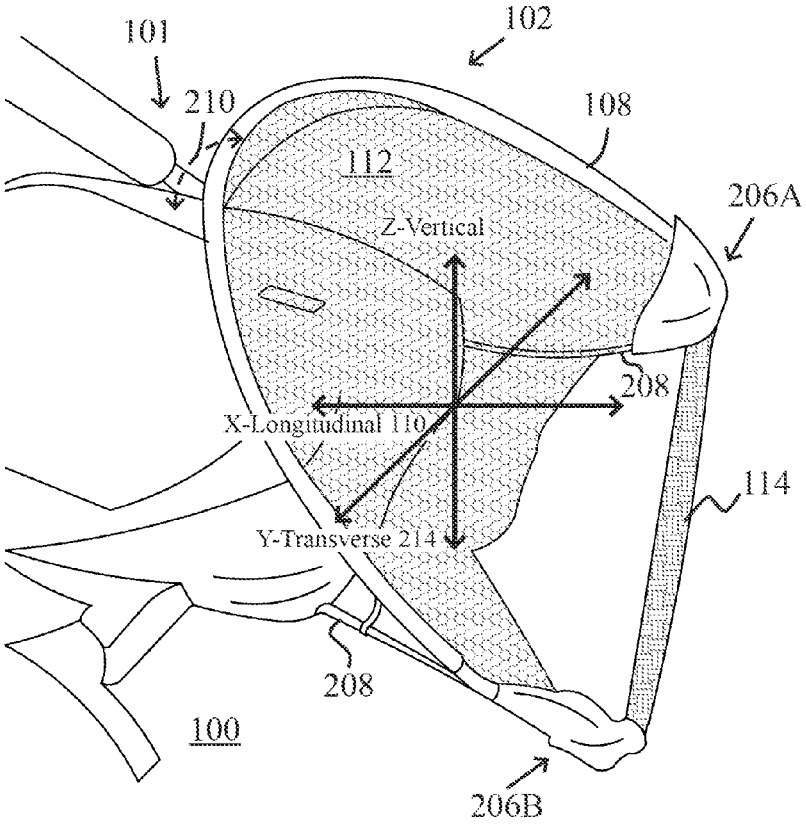

FIGS. 2A to 2F are non-limiting, exemplary illustrations of the device (the portable collapsible sports goal and backpack combination) of FIG. 1, progressively illustrating the gradual extraction of the portable collapsible sports goal from within the backpack in accordance with the present invention. FIG. 2A is an exemplary front view illustration of the sports goal pocket 106, which is positioned within the backpack 101 so to not hinder and obstruct easy access to the one or more pockets 104. After opening the sports goal pocket 106 (e.g., unzipping the pocket or compartment 106), users hand may easily reach into the sports goal pocket 106 and grab a frame 108 of the collapsible sports goal 102, and pull the entire collapsible sports goal 102 out of the sports goal pocket 106 opening 202 as illustrated in FIGS. 2A to 2F. Accordingly, the collapsible sports goal 102 is stored and extracted by moving along a longitudinal axis 110 of the backpack 101.

Figure 2F:
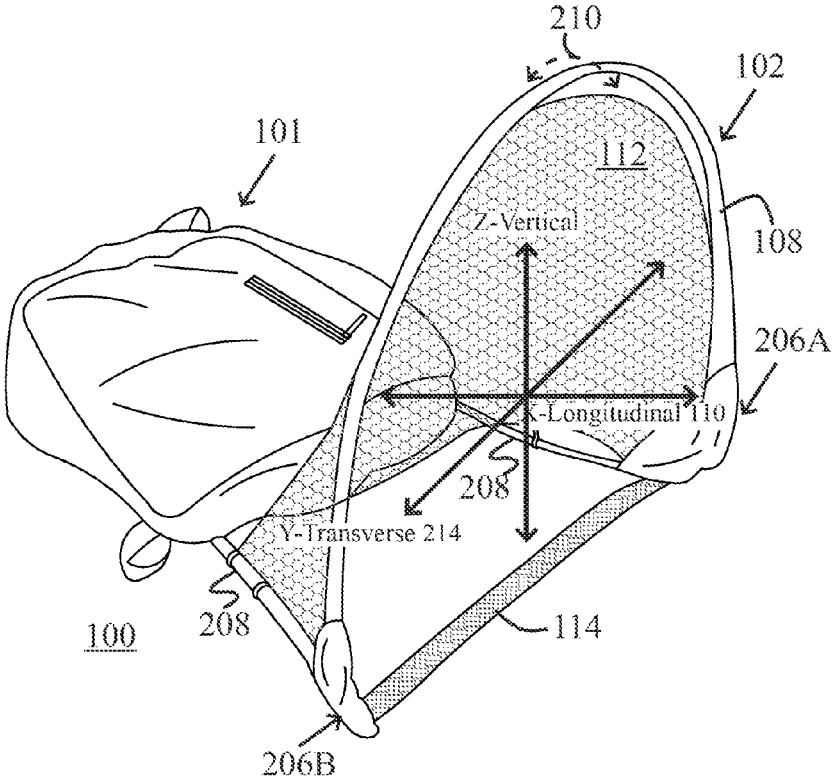
Figure 3A:
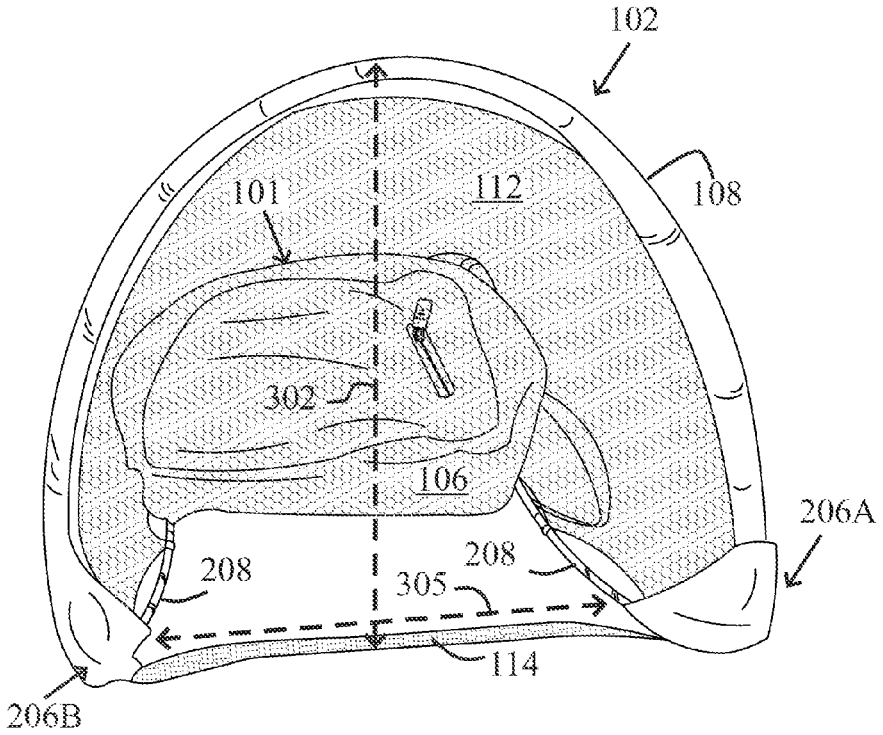
FIGS. 3A to 3D are non-limiting, exemplary illustrations of various views of a fully deployed portable collapsible sports goal and backpack shown in FIGS. 1 to 2F in accordance with the present invention.
Figure 3B:
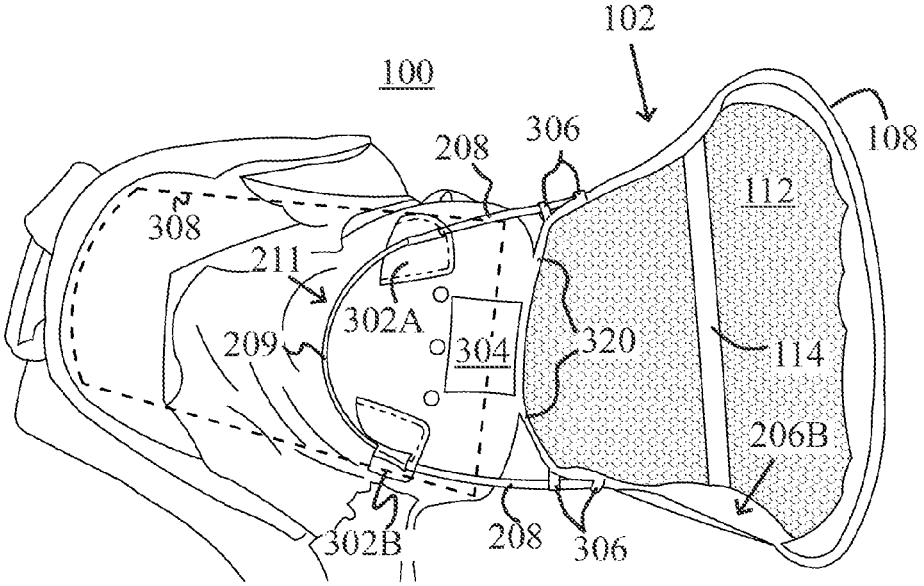
Figure 3C:
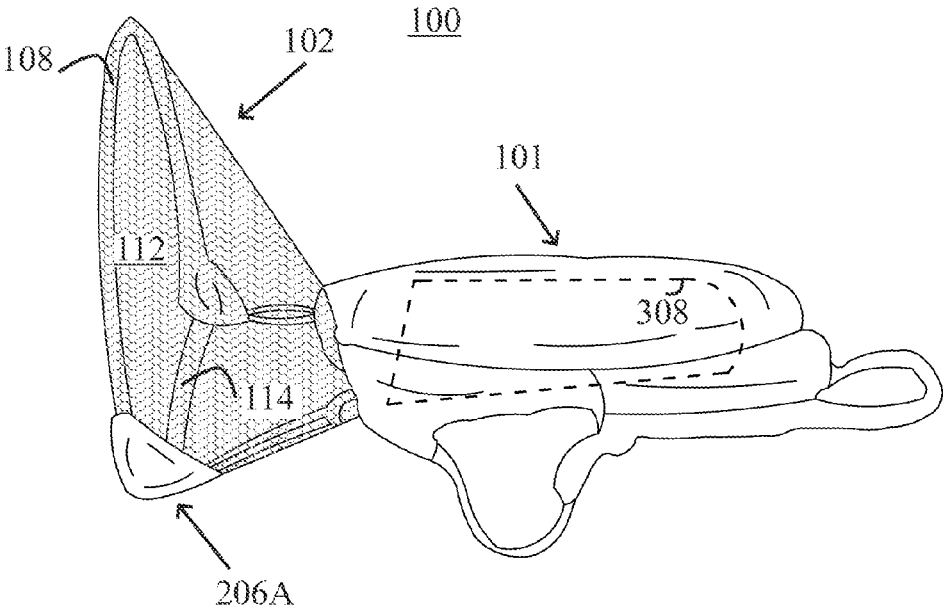
Figure 3D:
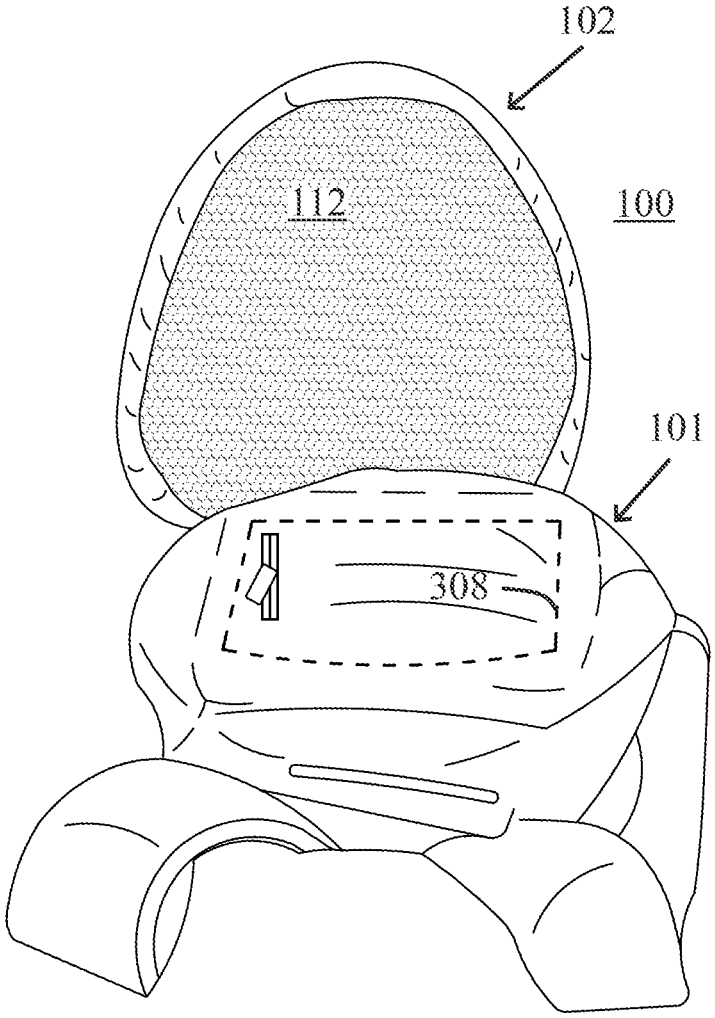
Figures 1, 4A:
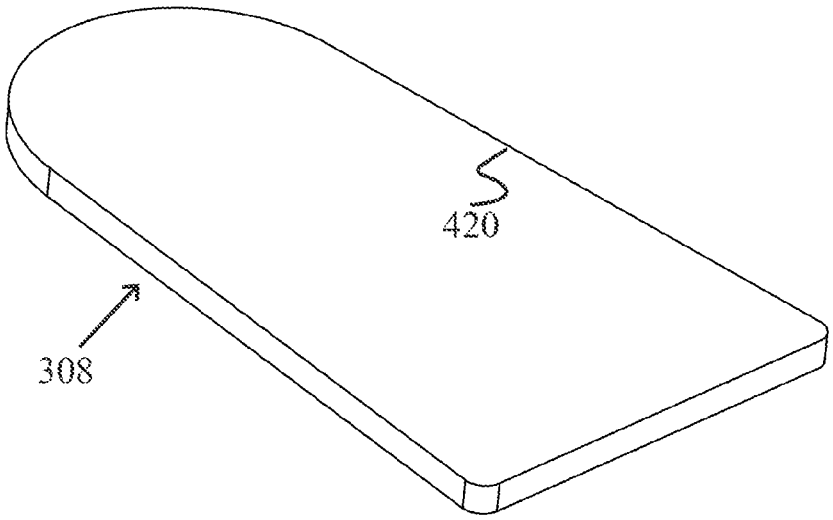
Figures 2, 4A:
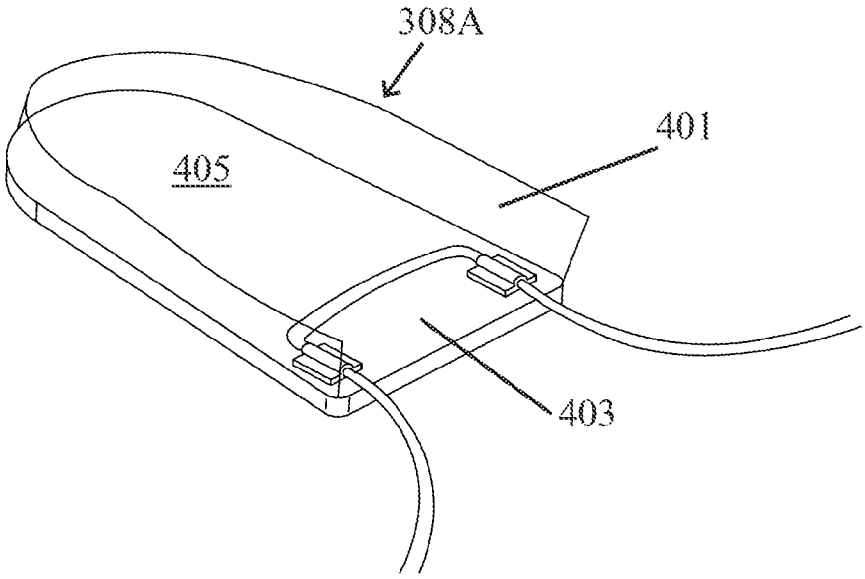

As further illustrated in FIGS. 1 to 2F (and in particular FIGS. 2D to 2F), while the collapsible sports goal 102 is pulled out of the sports goal pocket 106, the frame 108 tends to move to its default upright or open position (best illustrated in FIGS. 1, 2F, and 3A to 3D) when the frame 108 clears an outer edge 212 (FIG. 2D) of the sports goal pocket 106. In general, the frame 108 reciprocally moves along the arrow indicated by reference 210 to one of a closed (FIG. 2C) and open positions (FIG. 2F) along the longitudinal axis 110 (X-Z plane), pivoting about a transverse axis 214.

FIGS. 3A to 3D are non-limiting, exemplary illustrations of various views of a fully deployed portable collapsible sports goal and backpack shown in FIGS. 1 to 2F in accordance with the present invention. As illustrated in FIGS. 3A to 3D, the present invention 100 is comprised of a collapsible sports goal 102 that includes the frame 108 having a height 302 and a width 305. The frame 108 may be comprised of any configuration, non-limiting examples of which may include square, round, oval, etc. The sports goal 100 of the present invention further includes an anchor 211 that is flexibly associated with the frame 108. The anchor 211, which may be comprised of any shape and number of pieces, functions as a foundation that provides stability for the collapsible sports goal 102, capable of absorbing the impact of a moving object (e.g., a ball shown in FIG. 1A) due to the object's translational motion (or inertia). Most games require a net to catch an object of a game such as a ball and hence, the collapsible sports goal 102 also includes a net 112 associated with the frame 108 and a first section 208 of the anchor 211. A second section 209 of the anchor 211 extending beyond a lower portion 320 of the net 112, with the frame 108 and the anchor 211 moving in relation to one another between an open (default state is open) and a collapsed, closed positions (best illustrated in FIGS. 2A to 2F).

As further illustrated, frame 108 is comprised of a first and a second distal sections 206A and 206B that are associated with the anchor 211. The first and second distal sections 206A and 206B of the frame 108 are oriented along a common transverse plane (i.e., X-Y plane) of the anchors 211, while a substantially portion of a body of the frame 108 is substantially above the transverse plane to form an opening of the sports goal for receiving a playing object such as a ball, which is captured by the net 112.

The net 112 includes net attachment points 306 that allow for a use of a more compact frame 108, a lower transverse strap 114 that substantially maintains a transverse distance of the first and second distal sections 206A and 206B of the frame 108, and a middle back end coupling section 304 that couples (via exemplary fasteners 406) with a backpack 101 to stretch and extend the net 112 and encloses a bottom portion of the frame 108. As further illustrated in FIGS. 3A to 3D, the present invention 100 further includes an internal enforcement member 308 for added strength and stability (detailed below).

Figures 1, 4B:
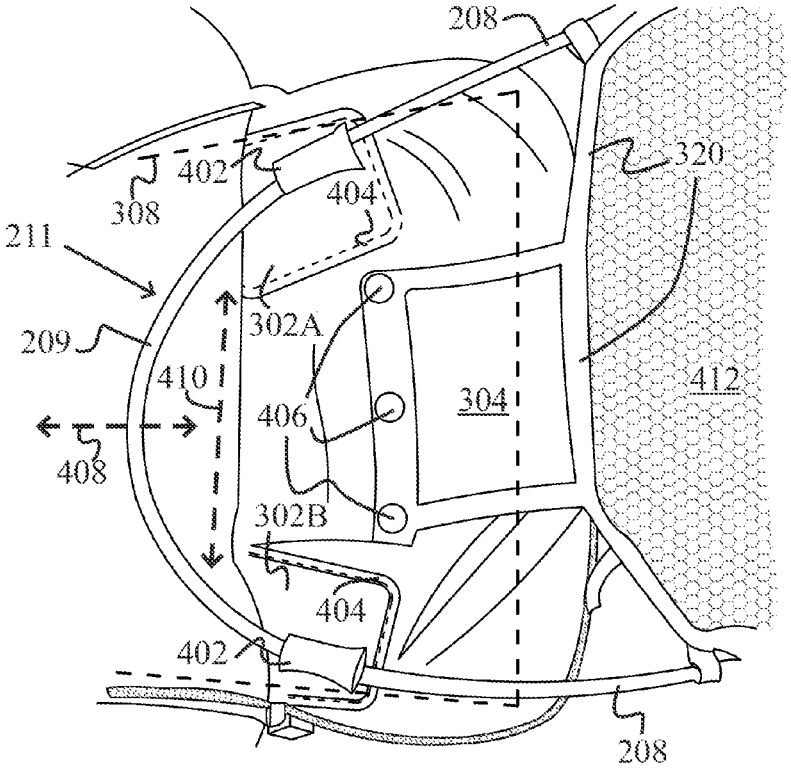
Figures 2, 4B:
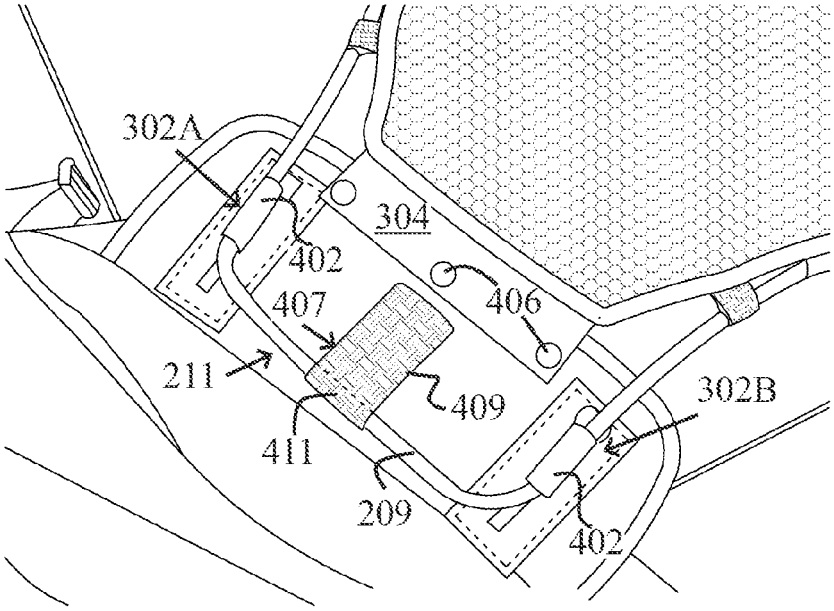
Figure 4C:
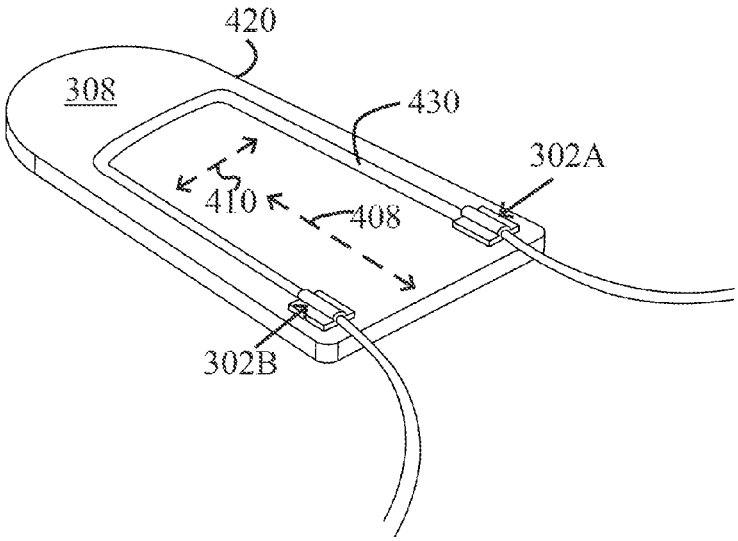
Figure 4D:
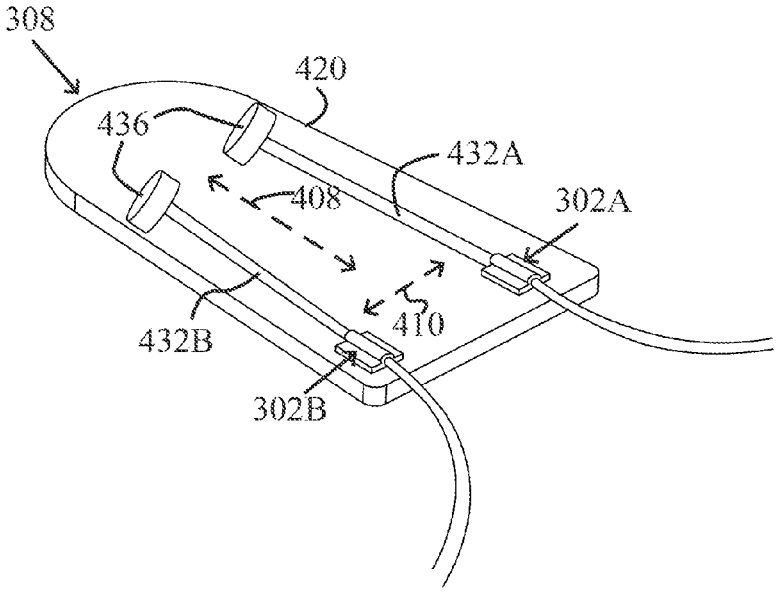
Figure 4E:
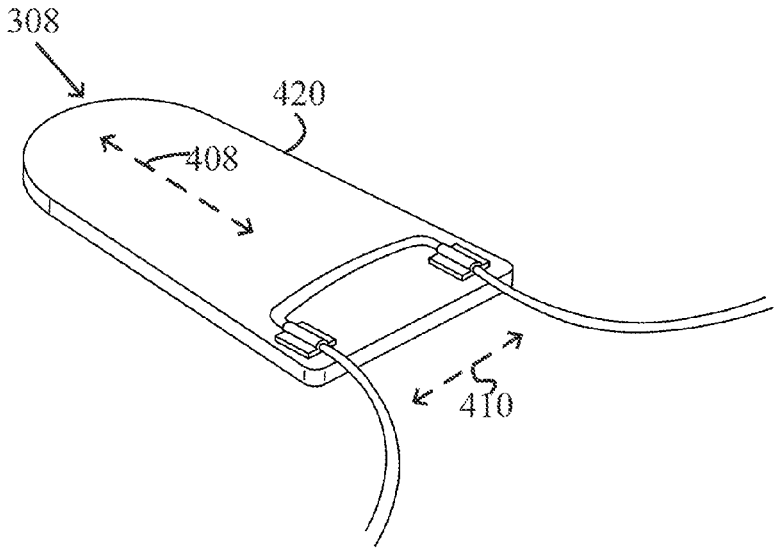
Figure 4F:
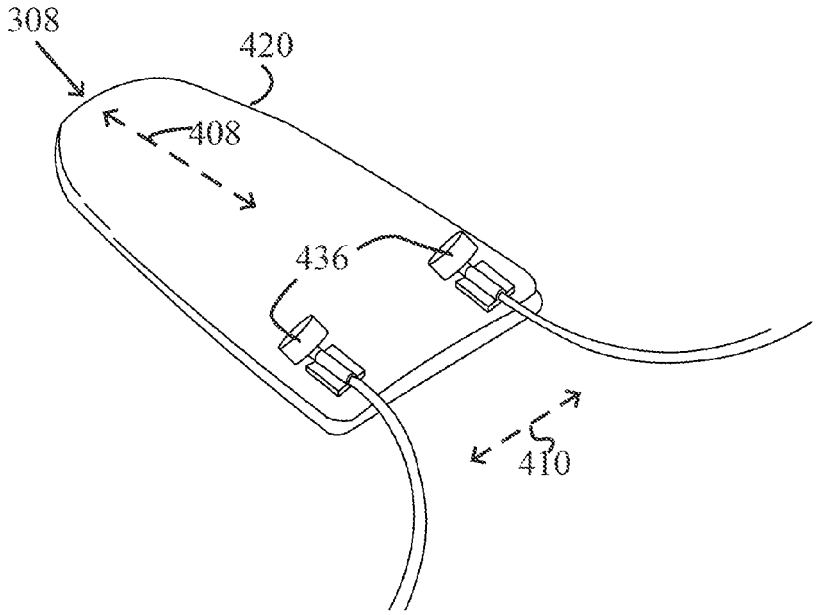

FIGS. 4A-1 to 4F are non-limiting, exemplary illustrations of an enforcement member and anchoring mechanisms of the portable collapsible sports goal and backpack shown in FIGS. 1 to 3D. At least one anchor 211 of one or more anchors is removably coupled with (direct or indirect) a reinforcement member 308 within the backpack 101, as best illustrated in FIGS. 3B to 4F. The reinforcement member 308 may comprise of one or more reinforcement member layers or pieces, and positioned between interior and exterior layers associated with the sports goal pocket 106 of the backpack 101 that accommodates the collapsible sports goal 102. The reinforcement member 308 may be of varying sizes, but is preferably of large surface area to provide a wide base upon which the anchor 211 is coupled through the anchor points 302A and 302B. The wider base provides greater stability, resisting against potential tilting of the collapsible sports goal 102 against the impact of a playing object such as a ball. The reinforcement member 308 may be thought of as the back or base support member that provides support and added stability to the collapsible sports goal 102. The layer 308 allows users the ability to place items anywhere inside the backpack 101 compartments and still provide distributed weight/rigidity to the anchor points 302A and 302B. This means that if the contents within the backpack 101 shift to one side, the weight thereof will continue to be substantially equally spread across the entire layer 308 that is within the outline 420 of the backpack 101, thus providing equal stability across the entire layer 308 and backpack 101.

The reinforcement member 308 may comprise of any material, such as plastic layer that is cut to match the outline 420 of the backpack 101 to increase the strength of the anchor points 302A and 302B. The layer 308 and anchor points 302A and 302B may also be a single piece to further improve rigidity. The layer 308 must have sufficient flexibility to provide comfort during wear/transport of the backpack 101. The location of the reinforcement member may be either in-between two layers of fabric so to conceal the piece 308 or sewn on top of the fabric within the sports goal pocket 106. For example, the backpack 101 layer may be organized as back padding section, layer 308, fabric cover, and the anchor points 302A and 302B fastened through the fabric cover and onto the layer 308. As an alternative example, the backpack 101 layers may be organized as a back padding section, one-piece layer with the anchor points 302A and 302B and with no top fabric cover.

FIG. 4A-2 is a non-limiting, exemplary illustration of a reinforcement member in accordance with another embodiment of the present invention. As illustrated, this reinforcement member 308A includes a vertical area 401 may function as a skeleton to the interior perimeter of the backpack 101, with a smaller horizontal section 403 that only extends under the anchor points to connect them to the perimeter vertical section 401, with an open area 405.

The perimeter vertical section 401 may also comprise a tube like structure and located at the base of the backpack 101. It should be noted that the reinforcement member may comprise of other configurations (e.g., a three-dimensional cage or frame). As another example, a skeletal frame that is configured to fit the interior perimeter of the backpack 101, with horizontal extensions connecting the skeletal frame to the anchor points may also be used. Any shape may be used so long as the reinforcement member is capable of providing greater stability and resisting against potential tilting of the collapsible sports goal 102 against the impact of a playing object such as a ball.

As best illustrated in FIGS. 4B-1 to 4F, the anchor may comprise of any shape and number of pieces, non-limiting examples of which are shown as anchor 211 (FIG. 4B), 430 (FIGS. 4C and 4E), and 432 (FIGS. 4D and 4F). They all function as a foundation that provides stability for the collapsible sports goal 102, capable of absorbing the impact of a moving object (e.g., a playing object such as a ball) due to the object's translational motion (inertia). Whether a single anchor 211 or 430, or two anchors 432A and 432B, the anchors are coupled with the reinforcement member 308 of the backpack 101 through an anchor points 302A and 302B. That is, at least one anchor of one or more anchors is coupled with the reinforcement member 308 of the backpack 101 through an anchor point 302A or 302B. The anchor points 302A and 302B include a guide 402 within which the anchor (211, 430, or 432A and 432B) slides through to one of open and closed positions of the collapsible sports goal 102. The separated anchors 432A and 432B include stop mechanisms 436, which prevent the anchors 432A and 432B from sliding out of the anchor points 302A and 302B. The anchor points 302A and 302B are preferably mechanically connected to the reinforcement member 308 via fasteners 404 for added stability and structural rigidity. The anchor points 302A and 302B may be coupled through the fabric of the interior chamber of the sports goal pocket 106 that houses the collapsible sports goal 102 with the reinforcement member 308.

As further illustrated in FIGS. 2A to 2F and 4B-1 to 4F pulling the collapsible sports goal 102 out of the sports goal pocket 106 opening 202 or pushing back into the sports goal packet 106 moves the anchor (any of the anchors illustrated) along longitudinal axis 110 of the device 100 along the reciprocating path 408 while simultaneously, the anchors move in a transverse direction 214 of the device 100 along the reciprocating path 410. That is, when the collapsible sports goal 102 is pulled out of the sports goal pocket 106 opening 202, the anchors move away from each other along the reciprocating path 410, which stretch the net 112 transversally to a distance 305 (FIG. 3A), and when the collapsible sports goal 102 is pushed back into the sports goal pocket 106, the anchors tend move towards one another, transversally collapsing the collapsible sports goal 102 to tightly fit within the sports goal pocket 106. Accordingly, whether a single piece (211 or 430) or a two-piece (432A and 432B) anchors is used, the anchor must have sufficient flexibility to accommodate their respective articulations along the reciprocating paths 408 and 410.

Figure 5A:
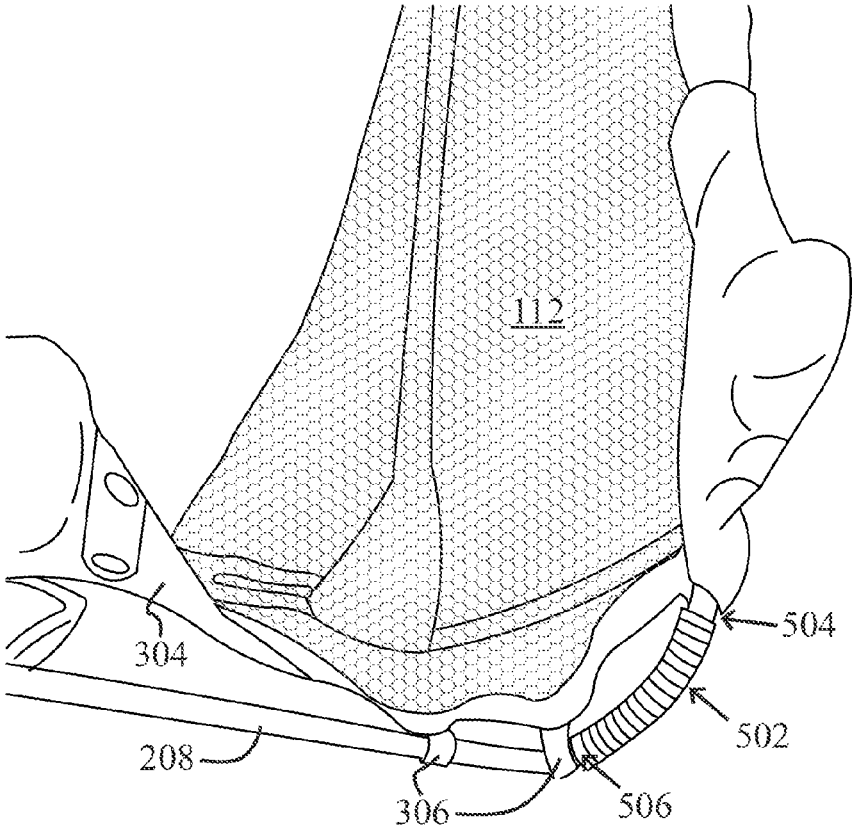
FIGS. 5A and 5B are non-limiting, exemplary illustrations of a resilient member of the portable collapsible sports goal and backpack shown in FIGS. 1 to 4F in accordance with the present invention.
Figure 5B:
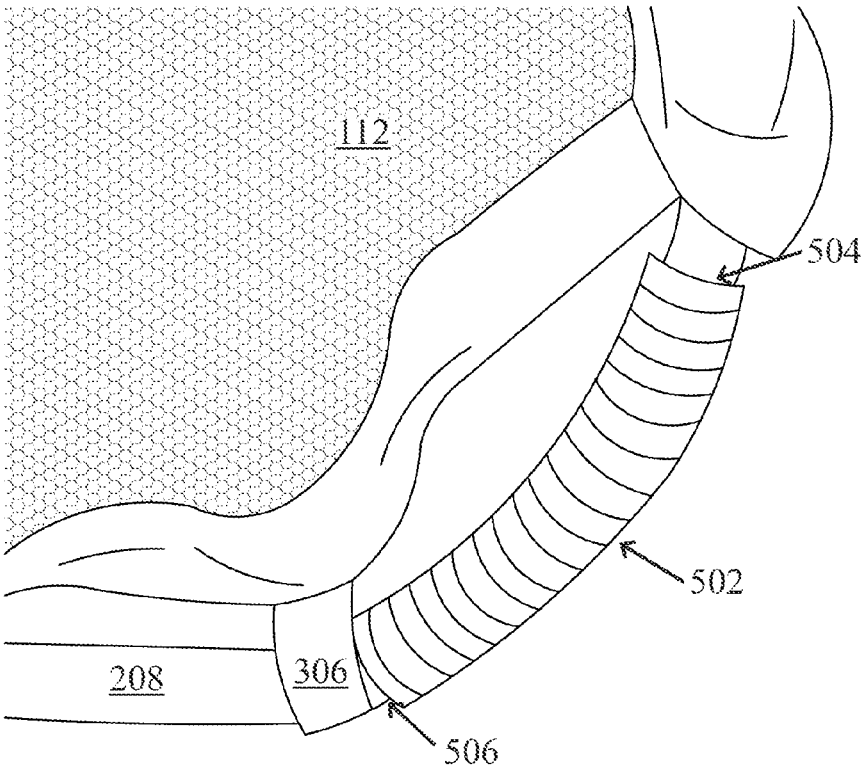
Figure 6A:
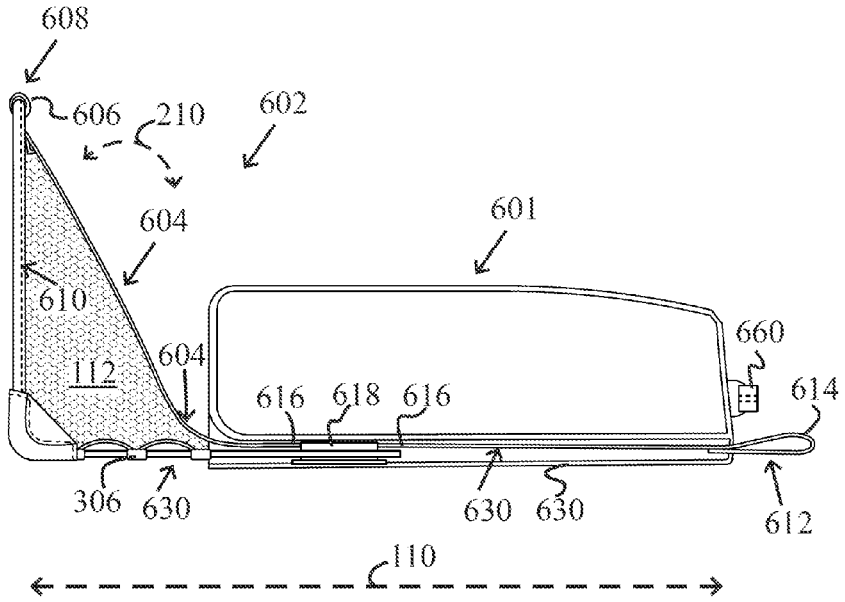
FIGS. 6A to 6G are non-limiting, exemplary illustrations of backpack and collapsible sports goal combination using a strap to collapse the sports goal in accordance with the present invention.
Figure 6B:
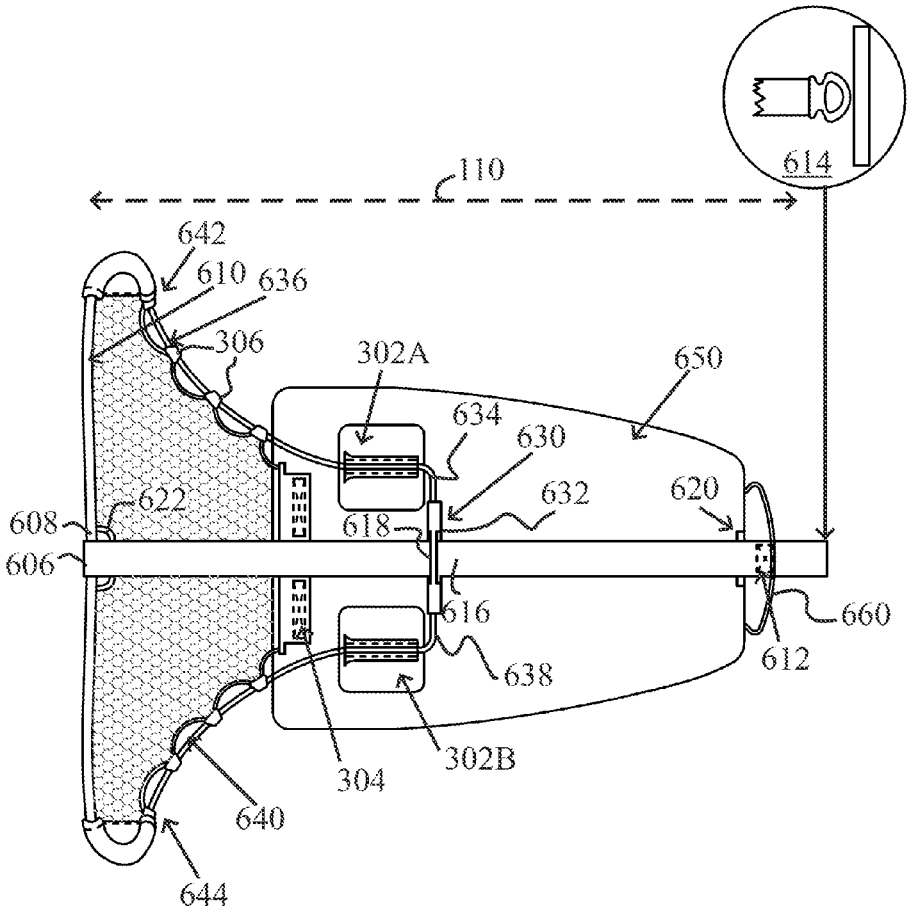
Figure 6C:
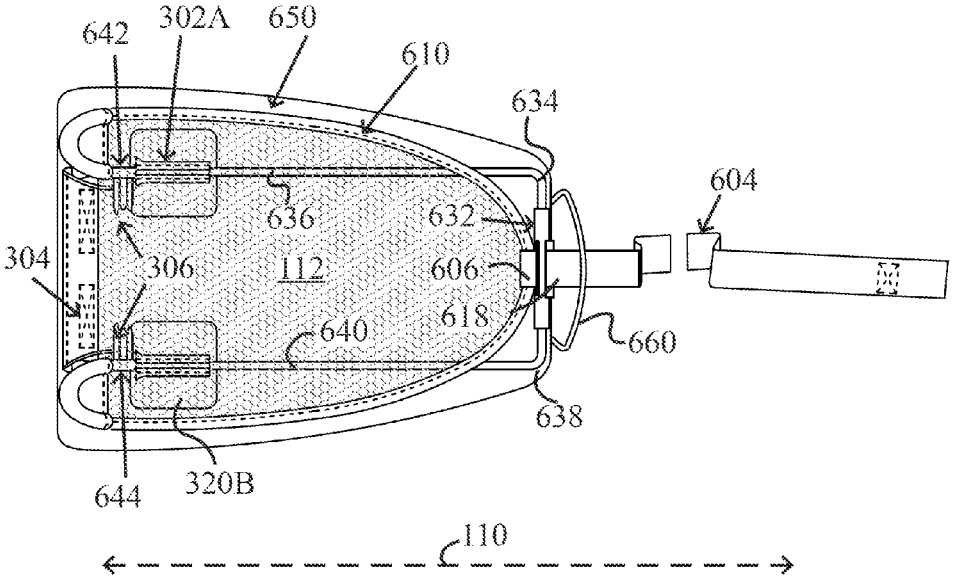
Figure 6D:
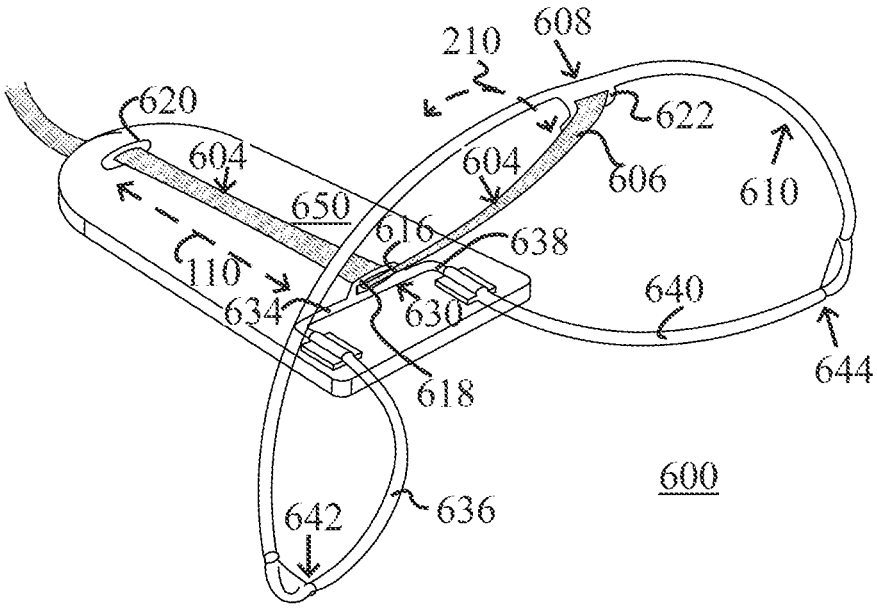
Figure 6E:
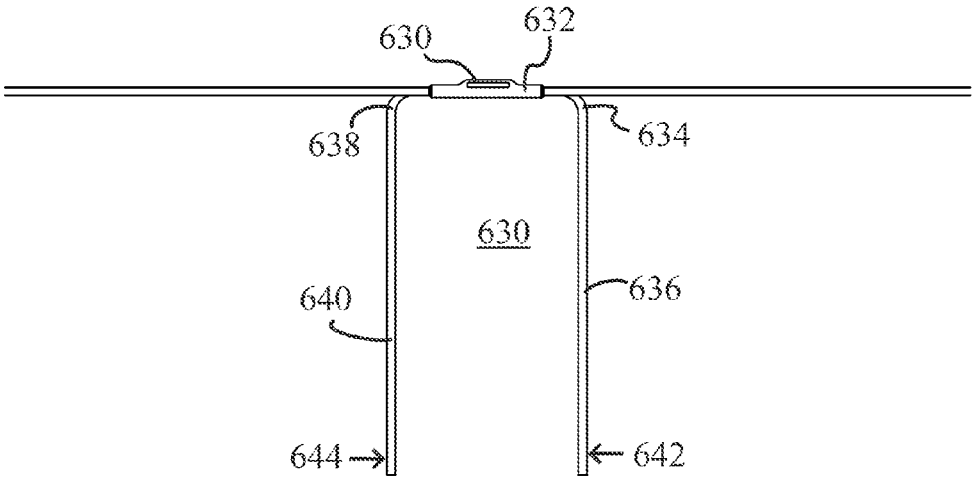
Figure 6F:
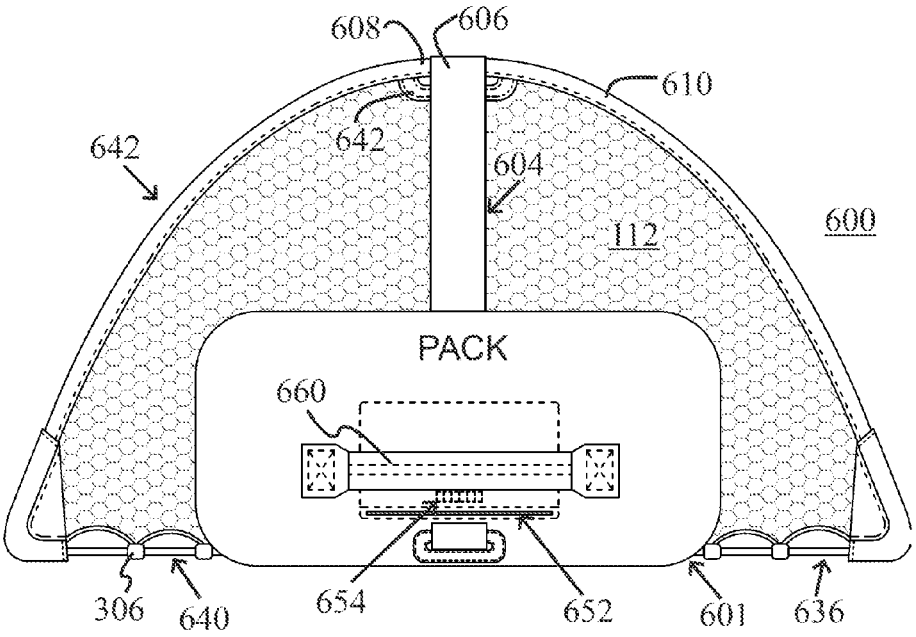
Figure 6G:
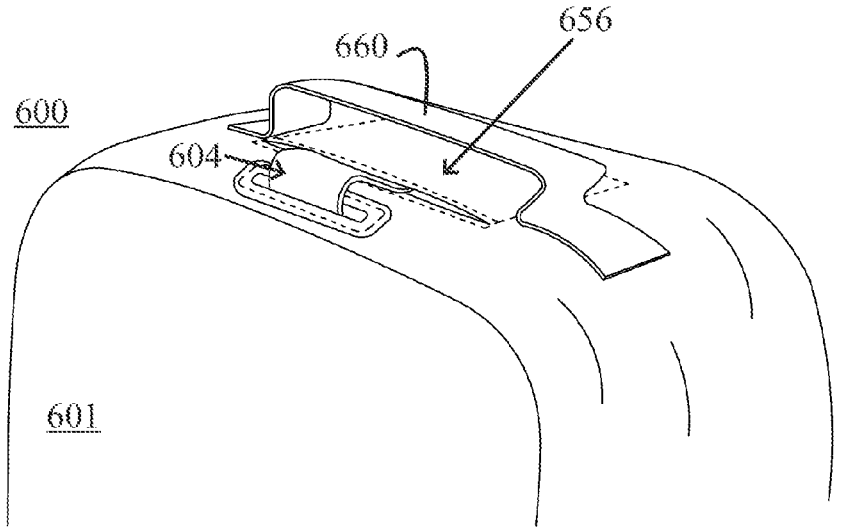

FIGS. 5A and 5B are non-limiting, exemplary illustrations of a resilient member of the portable collapsible sports goal and backpack shown in FIGS. 1 to 4F in accordance with the present invention. As illustrated, the first and second distal sections 206A and 206B include the first and second distal ends 504A and 504B of the frame 102, a resilient member 502, and the first and second distal ends 506A and 506B of the anchor 211. It should be noted that all elements of the first and second distal sections may comprise of an integral single piece, individual pieces, or a combination of both. For example, resilient member 502 may form an integral part of the frame 102, forming a single piece unit. As another example, the anchor 211, the resilient member 502, and the frame 102 may comprise of a single piece, with the resilient member 502 forming a compliant portion of the single piece. For example, the resilient member 502 may comprise of the same or different material, but have thinner dimensions, forming a "spring-hinge" allowing it to have a resilient characteristic. Alternatively, the resilient member 502 may comprise of another material that has increased flexibility with the same thickness as the anchor 211 and or frame 102. Nonetheless, the present invention provides a resilient member that is exemplarily illustrated as a helical coiled spring. As best illustrated in FIG. 5B, the first and the second ends 504A and 504B of the frame 102 are coupled with a first end of respective first and second resilient members 502A and 502B, and a first and second end 506A and 506B of the anchor 211 is coupled with a second end of the first and second resilient member 502A and 502B.

As best illustrated in FIGS. 2E, 2F and 4B-2, the frame 102 and the anchor 211 are moved towards one another against the bias of the resilient member 502 to a collapsed, closed position, with the resilient member 502 biasing the frame 102 and the anchor 21 away from one another to an erected, open position. The movement of the frame 102 and the anchor 211 to one of closed and open positions is along longitudinal axis 210 of the backpack 101, with the frame 102 pivoting along lateral sections 206A and 206B, at the resilient member 502, rotating about the transverse axis 214 of the backpack 101 towards and away from the anchor 21 to one of a closed and open positions. Besides allowing the collapsible sports goal 102 to close and open, additional advantage of such a movement is the capability of absorbing the impact of a moving object (e.g., a playing object such as a ball) due to the object's translational motion (inertia). The frame 102 yields (flexes in relation to the anchor 21) and functions as a "mechanical fuse" due to the impact of a playing object, thereby further impeding the objects translational motion. The frame 102 absorbs and then partially yields to the force of the playing object by flexing towards the anchor 211.

The anchor 211 also absorbs the impact of the force of the playing object by tending to move backward along the axial direction of the translation motion of the playing object. However, as best illustrated in FIG. 4B-2, the motion of the anchor 211 backwards is impeded or blocked by a lock mechanism 407 that may be detachably connected to either the body of the backpack 101 at one end 409 or the anchor section 209 at the other end 411. A non-limiting example of the lock mechanism 407 may include a Velcro strap that locks the frame in the extended position as shown in FIG. 4B-2, which insures lateral as well as longitudinal stability from impacts and insures the anchor 211 remain extended.

The tendency of the anchor 211 moving backwards (even if blocked by the lock mechanism 407) may continue to compel the entire backpack 101 to move in the direction of the force of the playing object. In such an instance, the backpack 101 (due to frictional surface tension between the backpack 101 and the ground) may slightly slide backward along the axial direction of the translational motion of the playing object. That is, upon impact of the translational motion of a mass (e.g., a ball), the frame 102 substantially absorbs the kinetic energy of the moving mass by flexing, which impedes the objects motion. The frame 102 remains intact after the impact of the mass by transferring this impacting force of the ball to the anchor 211, with the anchor 211 further absorbing the impact while remaining substantially in place (due to lock mechanism 407). The remaining force of the impact of the playing object is then further absorbed due to friction between the backpack 101 and the ground, which may partially yield to the transferred force by slight movement along the direction of the impacting force of the playing object (assuming the backpack 101 does not carry any articles such as books, bottles of water, etc. that may add additional weight, increasing friction, which in, turn, further impedes and prevents further movement thereof). That is, the frame 102 absorbs the kinetic energy and transfers it to the anchor 211, causing the anchor 211 to further absorb the energy and to transfer it to the backpack 101, which frictionally moves in the somewhat of a general direction of the force of the object. Accordingly, without the use of any anchoring pins or other accessories, the frame 102 and anchor 211 combination of the present invention substantially remain in place while impeding the translational motion of the playing object. Of course, addition of a limited weight (as stated above) on the anchor 211, for example, when the backpack 101 includes school books, would drastically improve stability and substantially reduce any ground motion.

FIGS. 6A to 6G are non-limiting, exemplary illustrations of backpack and collapsible sports goal combination 600 using a strap to collapse the sports goal in accordance with an alternative embodiment of the present invention. The combination 600 includes similar corresponding or equivalent components, interconnections, and or cooperative relationships as the combination 100 that is shown in FIGS. 1 to 5B, and described above. Therefore, for the sake of brevity, clarity, convenience, and to avoid duplication, the general description of FIGS. 6A to 6G will not repeat every corresponding or equivalent component and or interconnections that has already been described above in relation to combination 100 that is shown in FIGS. 1 to 5B.

As illustrated in FIGS. 6A to 6G, the backpack and collapsible sports goal combination 600 provides a storing strap 604 oriented along a longitudinal axis 110 of the backpack 601. The storing strap 604 includes a first distal end 606 coupled with an apex 608 of a frame 610, a mid-section 616 passing through an anchor strap bar 618, and a second distal end 612 passing through a reinforcement strap opening 620, and extending out and formed into a handle 614. As illustrated, pulling the storing strap 604 along the longitudinal axis 110 collapses the frame 610 along reciprocating path 210 and pulls the collapsible sports goal 602 within the sports goal packet 106 of the backpack 601 for storage.

The backpack 601 and collapsible sports goal 602 combination 600 further provides a frame 610 that includes strap bar 622 at the apex 608 of the frame 610, enabling connection of the first distal end 606 of the storing strap 604 to the strap bar 622.

Additionally, the backpack 601 and collapsible sports goal 602 combination 600 further provides an anchor mechanism 630 that is comprised of an anchor piece coupler 632 that includes a first opening or cavity for receiving a first distal end 634 of a first anchor piece 636, and a second opening for receiving a first distal end 638 of a second anchor piece 640. A second distal ends 642 and 644 of the respective first and second anchor pieces 636 and 640 are coupled with the frame 610. As further illustrated, the anchor piece coupler 632 further includes the anchor strap bar 618 that enables the strap 604 to pass through the anchor strap bar 618, maintaining the strap 604 near a surface of a reinforcement member 650.

The backpack 601 and collapsible sports goal 602 combination 600 further provides a reinforcement member 650 that includes the reinforcement strap opening 620 to enable the strap 604 to pass through and exit out of the backpack 601. The strap 604 existing the backpack 601 is stored within the strap storage compartment 652 (beneath the handle 660) that includes a VELCRO® type cover 654 (best illustrated in FIGS. 6F and 6G), forming a pocket to tuck in the extra strap 604 for transportation of the unit 600.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, additional connection can be established when the net is in its fully extended state to insure the lower frame does not slide into the pocket. This could be a simple strap with buckle, plastic stop, etc. The strap 114 is not limited to textile-based material, but it may include any flexible material, non-limiting example of which may include a flexible plastic piece. As another example, a layer of fabric need not be used to cover the reinforcement member within the pocket. That is, the reinforcement member may be exposed to the interior of the backpack pocket. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A sports goal, comprising:

a frame;

an anchor flexibly associated with the frame; a net associated with the frame and a first section of the anchor; and a second section of the anchor extending beyond a lower portion of the net;

a first and a second ends of the frame are coupled with a first end of respective first and second resilient members, and a first and a second ends of the anchor are coupled with a second end of respective first and second resilient members;

the frame and the anchor are moved towards one another against a bias of the resilient members to a collapsed position;

in the collapsed position, the frame and the anchor are moved in a first direction to slide into an attached casing the frame and the anchor are moved in a second direction to slide out of the casing, with the resilient members biasing the frame and the anchor away from one another to an erected, open position.

2. The sports goal as set forth in claim 1, wherein:

the anchor is comprised of one or more anchors.

3. The sports goal as set forth in claim 2, wherein:

the one or more anchors are associated with a carrying case.

4. The sports goal as set forth in claim 3, wherein:

at least one anchor of one or more anchors is removably coupled with a reinforcement member of the carrying case.

5. The sports goal as set forth in claim 4, wherein:

the reinforcement member is comprised of one or more reinforcement members.

6. The sports goal as set forth in claim 4, wherein:

the reinforcement member is positioned between interior and exterior layers associated with a pocket of the carrying case that accommodates the sports goal.

7. The sports goal as set forth in claim 4, wherein:

the reinforcement member is positioned within a pocket of the carrying case that accommodates the sports goal.

8. The sports goal as set forth in claim 3, wherein:

at least one anchor of one or more anchors is removably coupled with a reinforcement member of the carrying case via an anchor point, with the anchor point and the reinforcement member integrally formed into a single piece.

9. The sports goal as set forth in claim 8, wherein:

the anchor point includes a guide within which the anchor slides through to one of open and closed position.

10. The sports goal as set forth in claim 2, wherein:

at least one anchor of one or more anchors is coupled with the reinforcement member of the carrying case through an anchor point.

11. The sports goal as set forth in claim 1, wherein:

the case is a carrying case associated with the sports goal.

12. The sports goal as set forth in claim 11, wherein:

the carrying case is one of a backpack, duffel, tote, and carry-on case.

13. The sports goal as set forth in claim 11, wherein:

a storing strap oriented along a longitudinal axis of the case includes a first distal end coupled with an apex of the frame, and a second distal end formed into a handle, wherein pulling the storing strap along the longitudinal axis collapses the frame and pulls the sports goal within a backpack compartment for storage.

14. The sports goal as set forth in claim 1, wherein:

the frame is comprised of a first and a second distal sections that are associated with the anchor;

the first and second distal sections of the frame are oriented along a common transverse plane of the anchors, while a substantial portion of a body of the frame is substantially perpendicular to the transverse plane to form an opening of the sports goal for receiving a playing object, which is captured by the net.

15. The sports goal as set forth in claim 14, wherein:

the first and second distal sections are the first and second distal ends.

16. The sports goal as set forth in claim 1, wherein:

the resilient member forms an integral part of the frame, forming a single piece unit.

17. The sports goal as set forth in claim 1, wherein:

the anchor is an integral part of the frame, forming a single piece.

18. The sports goal as set forth in claim 1, wherein:

the anchor and the frame form two separate pieces.

19. The sports goal as set forth in claim 1, wherein:

the anchor, the resilient members, and the frame are comprised of a single piece, with the resilient members forming a compliant portion of the single piece.

20. The sports goal as set forth in claim 1, wherein:

the resilient member is a helical coiled spring.

21. The sports goal as set forth in claim 1, wherein:

the anchor includes a first anchor and a second ancho4r;

wherein the first and second anchor are joined by an anchor coupler.

22. The sports goal as set forth in claim 1, wherein:

a movement of the frame and the anchor to one of closed and open positions is along a longitudinal axis of the sports goal.

23. The sports goal as set forth in claim 1, wherein:

the frame pivots along lateral sections, at the resilient members, rotating along the longitudinal axis of the sports goal towards and away from the anchor to one of a closed and open positions.

24. The sports goal as set forth in claim 1, wherein:

the net includes:

net attachment points that allows for a use of a compact frame;

a lower transverse strap that substantially maintains a transverse distance of the first and second distal sections of the frame;

a middle back end coupling section that couples with a backpack to stretch and extend the net and encloses a bottom portion of the frame.

25. A sports goal, comprising:

an attached casing that houses:

a reinforcement member;

an anchor associated with the reinforcement member;

a frame associated with the anchor; and a net associated with the anchor and the frame;

the frame and the anchor are moved towards one another against a bias of a resilient members to a collapsed position;

in the collapsed position, the frame and the anchor are moved in a first direction into the casing, with the anchor having a first motion along longitudinal axis and transverse axis of the reinforcement member, which further contracts the frame to a fully closed position;

the frame and the anchor are moved in a second direction to slide out of the casing, with the anchor having a second motion along longitudinal axis and transverse axis of the reinforcement member to expand the frame while the resilient members biases the frame and the anchor away from one another to an erected, open position.

26. The sports goal as set forth in claim 25, wherein:

the movement of the frame and the anchor to one of closed and open positions is along longitudinal axis of the casing, with the frame pivoting along lateral sections, at the resilient members, rotating about a transverse axis of the casing towards and away from the anchor to one of a closed and open positions.

27. A sports goal, comprising:

an attached casing that houses:

a reinforcement member;

an anchor associated with the reinforcement member;

a frame associated with the anchor; and a net associated with the anchor and the frame;

a first and a second ends of the frame are coupled with a first end of respective first and second resilient members, and a first and a second ends of the anchor are coupled with a second end of respective first and second resilient members;

the frame and the anchor are moved towards one another against a bias of the resilient members to a collapsed position;

in the collapsed position, the frame and the anchor are moved in a first direction, sliding over the reinforcement member and into the casing to the closed position, the frame and the anchor are moved in a second direction to out of the casing, with the resilient members biasing the frame and the anchor away from one another to an erected, open position.

* * * * *